US007997576B2

(12) United States Patent
Curina et al.

(10) Patent No.: US 7,997,576 B2
(45) Date of Patent: Aug. 16, 2011

(54) EQUIPMENT FOR PROCESSING BANKNOTES IN STACK

(75) Inventors: Maurizio Curina, Bollengo (IT); Felice Giacone, Bollengo (IT)

(73) Assignee: CTS Cashpro S.p.A., Bollengo (IT)

( * ) Notice: Subject to any disclaimer, the term of this patent is extended or adjusted under 35 U.S.C. 154(b) by 269 days.

(21) Appl. No.: 12/094,554

(22) PCT Filed: Nov. 20, 2006

(86) PCT No.: PCT/EP2006/068689

§ 371 (c)(1),
(2), (4) Date: May 21, 2008

(87) PCT Pub. No.: WO2007/057471

PCT Pub. Date: May 24, 2007

(65) Prior Publication Data

US 2008/0284085 A1 Nov. 20, 2008

(30) Foreign Application Priority Data

Nov. 21, 2005 (IT) ..... TO2005A0822

(51) Int. Cl.
*B65H 29/66* (2006.01)
*B65H 31/00* (2006.01)
*B65H 85/00* (2006.01)

(52) U.S. Cl. ..... 271/202; 271/3.14

(58) Field of Classification Search ..... 271/3.14, 271/202, 207, 203, 206, 209, 220
See application file for complete search history.

(56) References Cited

U.S. PATENT DOCUMENTS 5,071,113 A * 12/1991 Nakamura et al. ..... 271/267
5,116,042 A * 5/1992 Hamanaka ..... 271/176
5,129,642 A * 7/1992 Svyatsky et al. ..... 271/10.03
5,499,805 A * 3/1996 Anma ..... 271/3.05
5,984,304 A * 11/1999 Wacker ..... 271/288
6,378,864 B1 * 4/2002 Iesaka ..... 271/270
6,572,103 B1 * 6/2003 Tranquilla ..... 271/265.02
(Continued)

FOREIGN PATENT DOCUMENTS

EP 1 008 965 A 6/2000
(Continued)

OTHER PUBLICATIONS

International Search Report of PCT/EP2006/068689, completion date Feb. 12, 2007, mail date Feb. 23, 2007.

*Primary Examiner* — Kaitlin S Joerger
*Assistant Examiner* — Patrick Cicchino
(74) *Attorney, Agent, or Firm* — Banner & Witcoff, Ltd.

(57) ABSTRACT

Equipment for processing banknotes in stack, as an example for a banking deposit, including a transport mechanism for banknotes or similar sheets, and a receiving section the banknotes or sheets are transported at a given transport velocity (Vt) and the receiving section is arranged downstream of a section of the transport mechanism for receiving, in superimposition, the banknotes or sheets. The equipment comprises an interface mechanism with nipping members interposed between the transport mechanism and the receiving section and electronic control circuits which cause the nipping members to slow down the banknotes or sheets of the receiving section at a reduced velocity (Vb), in response to information of transit of the banknotes or sheets, making easy a regular stacking of the banknotes or sheets.

1 Claim, 9 Drawing Sheets

U.S. PATENT DOCUMENTS

| | | | | |
|---|---|---|---|---|
| 6,626,428 | B2 * | 9/2003 | Soga et al. | 271/182 |
| 6,663,102 | B2 * | 12/2003 | Takahashi et al. | 271/217 |
| 7,384,042 | B2 * | 6/2008 | Sakakibara et al. | 271/270 |
| 7,428,983 | B2 * | 9/2008 | Nomiyama et al. | 235/379 |
| 7,458,573 | B2 * | 12/2008 | Park | 271/122 |
| 2002/0171197 | A1 * | 11/2002 | Ardery et al. | 271/209 |
| 2003/0015396 | A1 | 1/2003 | Mennie | |
| 2004/0119227 | A1 | 6/2004 | Duncan | |
| 2004/0134839 | A1 * | 7/2004 | Kobayashi et al. | 209/534 |
| 2005/0067764 | A1 * | 3/2005 | Tamura et al. | 271/220 |

FOREIGN PATENT DOCUMENTS

| | | | |
|---|---|---|---|
| EP | 1 544 806 | A2 | 6/2005 |
| JP | 2002117433 | * | 4/2002 |

* cited by examiner

EQUIPMENT FOR PROCESSING BANKNOTES IN STACK

CROSS REFERENCE TO RELATED APPLICATIONS

This application is the national phase filing of PCT Application No. PCT/EP2006/068689, filed Nov. 20, 2006, which claims priority to Italian Patent Application No. TO2005A000822, filed on Nov. 21, 2005, the subject matter of which is incorporated by reference herein in its entirety.

FIELD OF THE INVENTION

The present invention relates to an equipment for processing banknotes in stack.

The invention relates, more specifically, to an equipment and a method for processing banknotes in stack, for instance for a banking deposit, which provides individual transport of the banknotes and includes a receiving section for receiving in superimposition the transported banknotes.

BACKGROUND OF THE INVENTION

Equipments for processing banknotes in stack are known, for instance in the use as automatic teller machines for banking deposit which form, in the inside, bundles of piled banknotes which are moved in unitary way. These equipments provide un-stacking or separating operations of the deposited stack of banknotes, the check of the sheets constituting the stack and the validation of the banknotes. It follows the formation of a bundle of the not recognized sheets, to be returned to the customer and the formation of a bundles or sub-stack of the validated banknotes, to be separated and to be further validated, for a deposit in account and transfer in a safe, or for the return to the customer in the case of afterthought.

An equipment for the deposit of stacked banknotes of the above-mentioned type has been described in the European patent application EP 1 544 806, filed on Dec. 13, 2004 and assigned to CTS Cashpro S.p.A. This equipment comprises, as receiving section, a box assembly with two storage boxes, which is movable in height for receiving banknotes and components not recognized and forming respective bundles or sub-stacks. The box assembly is further shifted for positioning the sub-stacks of banknotes and components not recognized in different areas of the equipment on following operative steps.

A problem of the equipments which process, as wholes, bundles or sub-stacks of banknotes and other overlapped sheets relates to the fact that the formation of the sub-stacks presents risks of jams, which can not be solved by the customer and could put the equipment out of use for the following customers. The drawbacks are particularly evident, when the deposited stack comprises worn-out banknotes, banknotes of different dimensions and/or in the case in which the number of the banknotes to be processed is high with respect to the available spaces. The remedies can provide the lowering of the operational speed, the reduction of the maximum number of banknotes in the stack, and/or the use of complex stacking mechanisms.

SUMMARY OF THE INVENTION

Object of the present invention is an equipment and a method for processing banknotes in stack, having high operational speed and great reliability also in presence of worn-out banknotes.

Another object of the invention is an equipment for processing banknotes in stack of different dimensions, in detail the banknotes of the European system, which is fast and reliable and of reduced dimensions and which has a relatively high capability of processing.

The above-defined objects are accomplished by an equipment for processing banknotes in stack, for instance for a banking deposit, including a transport mechanism for individually transporting banknotes or similar sheets, and a receiving section for receiving, in superimposition, transported banknotes or sheets. The equipment further comprises an interface mechanism with nipping members interposed between a section of the transport mechanism and the receiving section. Electronic control circuits are operative on the interface mechanism for slowing down the banknotes or sheets at the input of the receiving section in order to make easy a regular piling of the banknotes or sheets. The nipping members are engageable with the banknotes or sheets outgoing from the said section of the transport mechanism for their transport at a velocity (Vb, Vr) reduced with respect to the transport velocity (Vt) and the electronic circuits control the interface mechanism in response to the information of transit of the banknotes or sheets.

BRIEF DESCRIPTION OF THE DRAWINGS

The characteristics of the invention will become clear from the following description given purely by way of non-limiting example, with reference to the appended drawings in which.

DETAILED DESCRIPTION OF THE PREFERRED EMBODIMENTS

Figures 1, 1A:
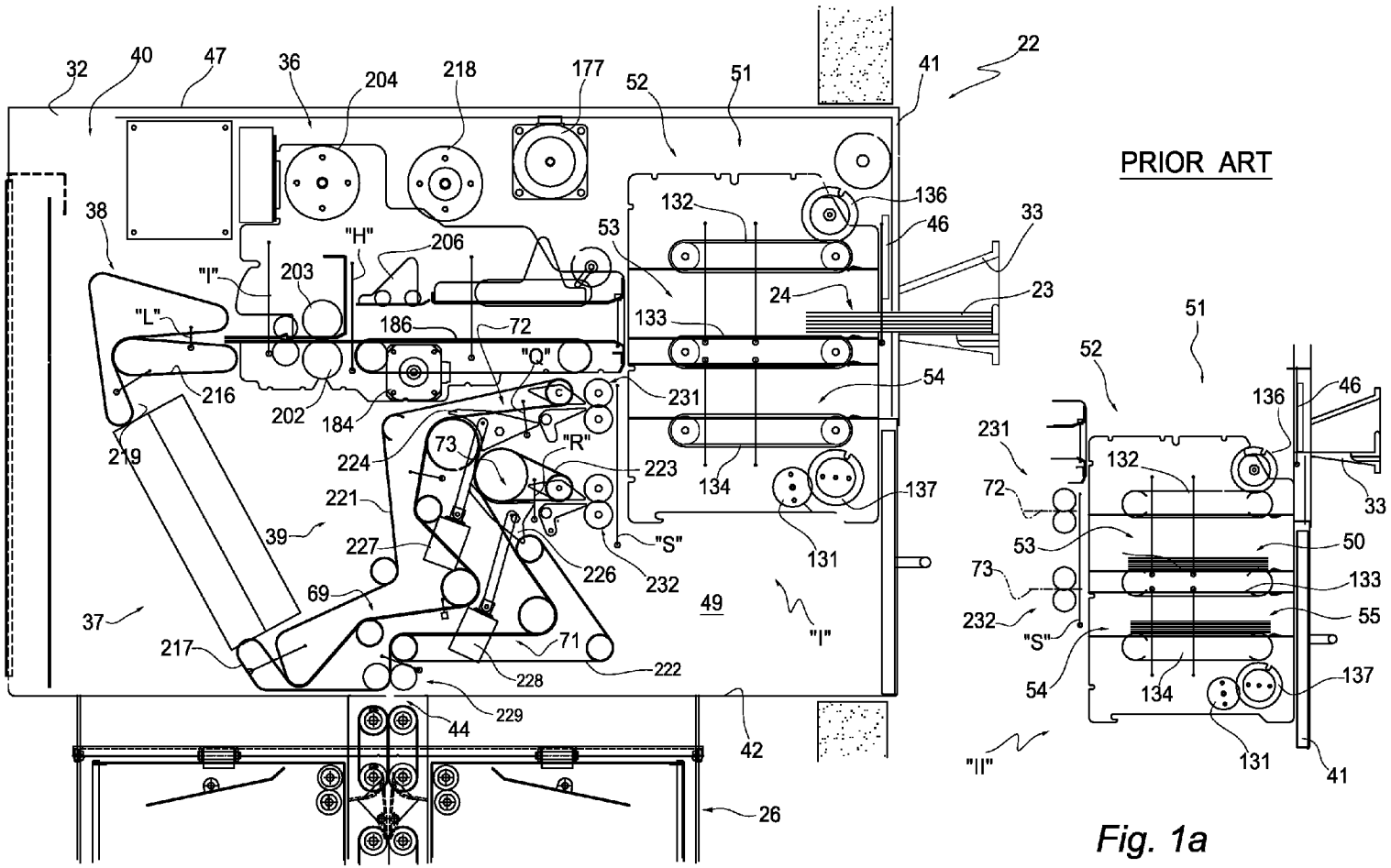
PRIOR ART Fig. 1a
FIG. 1 represents, in schematic way, a lateral view of an equipment for processing banknotes in stack according to the prior art.
FIG. 1*a* is a detail of the equipment represented in FIG. 1 in an operational configuration.

With reference to FIG. 1, an equipment for the automatic deposit of banknotes of the type described in the above-mentioned European patent application EP 1 544 806 is represented with 22. This application is incorporated herein for reference and the components with identical function maintain a same denomination. The banknotes 23 to be deposited are assembled in a stack 24 and, after automatic validation, are provided for being transferred in a store-safe 26 underlying the equipment 22, with accredit of the respective values to a customer account.

In synthesis, the equipment 22 includes a containing structure 32, of parallelepiped shape, with a transaction port 33 and, inside, a separating device 36, a validation device 37, a transport mechanism having a section 38 and a section 39, respectively upstream and downstream of the validation device 37, an electronic processing unit 40 and a box assembly 52.

A shutter door 46 for the transaction port 33 and a servomechanism are mounted on a front 41 of the structure 32. At the base of the structure 32 an opening 44 at the input of the store-safe 26 is provided. The insertion of the stacks 24 and the moving of the single banknotes occur along the longitudinal sense of the banknotes. A frame 47 supports the various devices and mechanisms of the equipment 22.

The validation device 37 analyzes the moving sheets separated by the device 36, recognizing the banknotes validated for the deposit and the non-acceptable constituting sheets. The separating device 36 and the section 39 of the transport mechanism are spaced away from the front 41 and delimit a passage space 51. The box assembly 52 is lodged in the space 51 and has possibility of shifting in vertical between three positions or operational levels.

The box assembly 52 includes a banknote box 53 and a discard box 54 arranged at different heights, respectively upper and lower, which define corresponding receiving sections for overlapped bundles of banknotes and other sheets. The box 53 receives the stack 24 of the banknotes presented by the customer for the deposit and, in a following step, the validated banknotes separated from the stack, as sub-stack banknote sub-stack 50 (FIG. 1*a*). The box 54 receives the sheets and the other refused components as discard sub-stack 55.

Figure 2:
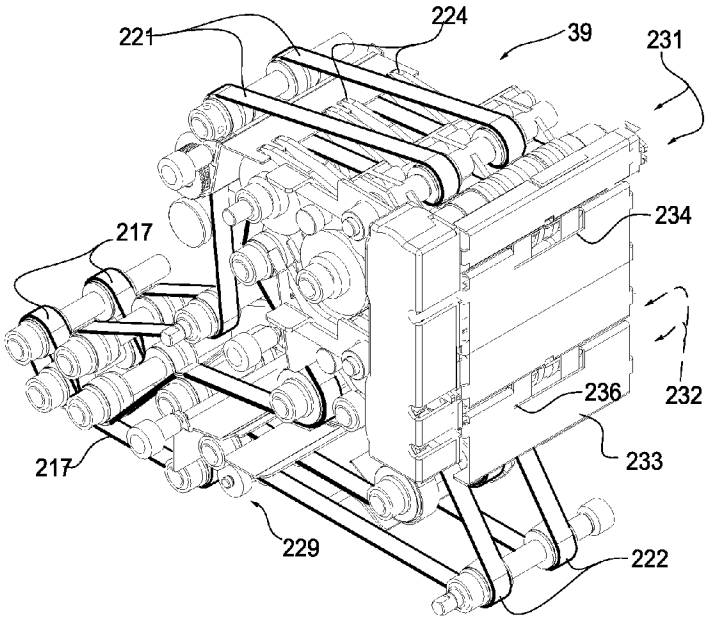
PRIOR ART Fig. 2
FIG. 2 shows in perspective some component ones of the equipment of FIG. 1.
Figure 2:
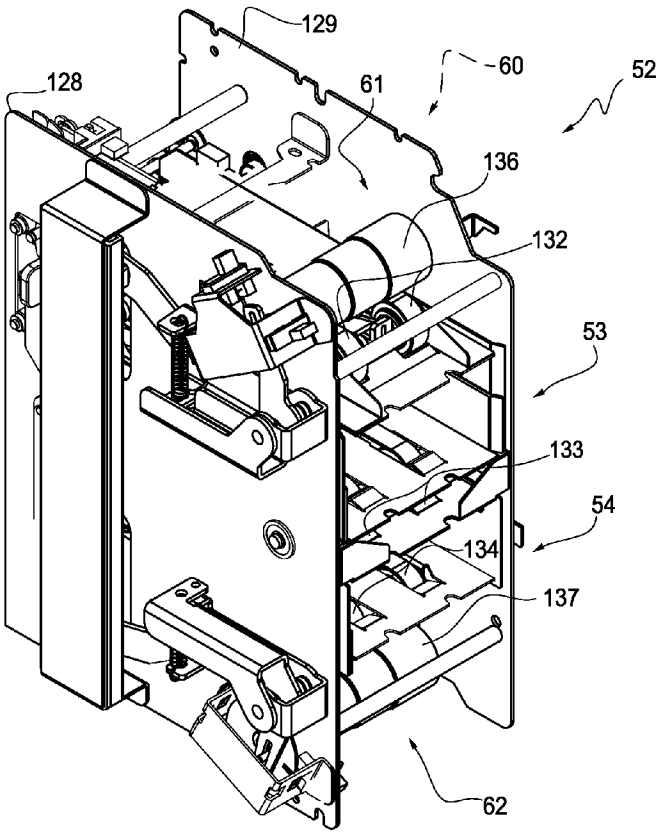
PRIOR ART Fig. 2

A moving mechanism 60 and two holding mechanisms 61 and 62 (FIG. 2), move the stack 24 or the sub-stacks 50 and 55 (FIG. 1*a*) in a step of introduction and in association with a temporary acceptance of the sheets constituting the stack. The moving mechanism 60 and the holding mechanisms 61 and 62 are actuatable by a motor 131 and by respective motors 136 and 137 controlled by the processing unit 40 (FIG. 1).

A motor 177, also controlled by the processing unit 40, actuates a vertical shifting mechanism for the box 52 as described in the cited European patent application EP 1 544 806. A first position "I" of the block 52 is functional to the deposit of the stack 24 in the transaction port 33 and to the return to the customer. A second lower position "II", shown in FIG. 1*a*, concerns particular steps of the procedure of deposit and a third higher position, not shown, is functional to the return of the discards.

The section 39 of the transport mechanism (FIG. 1) is designed for moving the banknotes and the other sheets outputted from the device 37 along a common path 69. From the path 69 the sheets constituting the stack are directed toward a path of deposit-capture 71 or toward a path for recognized banknotes 72 or toward a path for constituting sheets not recognized 73. The path of deposit-capture 71 is directed toward the opening 44 for the store safe 26, whilst the path 72 and the path 73 are direct toward the box assembly 52.

In detail, the paths 72 and 73 have output sections arranged at different height and in a condition of substantial vertical coplanarity and are respectively functional to the formation of the sub-stacks 50 and the sub-stacks 55. Diverters controlled by electromagnets, in turn controlled by the processing unit 40, effect the selection of the paths.

The movement of the banknotes and the other sheets constituting the stack and the sub-stacks is controlled by photoelectric couples (photo-emitter and photo-sensor) represented in schematic way by alphabetical letters. Photoelectric couples "H" and "I" for the separating device 36, and a photoelectric couple "L" at the input of the section 38 of the transport mechanism are provided. Further, photoelectric couples "Q" and "R" are arranged at the final portion of the output sections of the paths 72 and 73 and a couple "S" is common to the inputs of the passage space 51.

At rest, the box assembly 52 is in the position "I" (FIG. 1) with the banknote box 53 adjacent to the transaction port 33. Activation of the equipment 22 by a customer causes the opening of the door 46. In the insertion step, the stack 24 introduced in the transaction port 33 partially engages the box 53. The program actuates in sequence the holding mechanisms for the stack 24, the moving mechanism for the block 52 and the servomechanism of the door 46, with complete transferring of the stack 24 in the box 53 and closing of the door.

The program causes the stack 24 to move to the separating device 36, and the box assembly 52 to be positioned in the position "II" (FIG. 1*a*). The banknote box 53 is now arranged in front of the output section of the path 72 for receiving the recognized banknotes, whilst the discard box 54 is in front of the output section of the path 73 for receiving the unrecognized constituting sheets.

In a step of validation, the stack 24 is separated and the single constituting sheets pass one after the other in front of the validation device 37. In response to respective recognition codes, the electromagnets of the various diverters are selectively activated and the section 39 of the transport mechanism singly move the banknotes and the other constituting sheets along the common path 69 and, in alternative, along the paths 71 or 72 or 73.

The validated banknotes of the path 72 are piled to form the bundle or banknote sub-stack 50 in the box 53 (see FIG. 1*a*). The constituting sheets not recognized of the path 73, as generic sheets or, typically, the banknotes recognized as worn-out, are also piled and form the bundle or discard sub-stack 55 in the box 54.

The processing unit 40 proceeds with a restitution step, in which the box assembly 52 is moved to the highest position, the door 46 is opened and the discard sub-stack 55 is moved in the transaction port 33 for the withdrawal of the constituting sheets not recognized.

If the customer accepts to continue, the box assembly 52 is carried back in the position "I", and the moving mechanism moves the sub-stack 50 of the validated banknotes in the device 36 for another separation operation. The single banknotes are further validated and the respective values accounted and accredited, whilst the transport mechanism moves the banknotes in the store-safe 26, along the path 71 and through the opening 44.

For the restitution of the validated banknotes, on request of the customer, the box assembly 52 is carried in the position "I", the door 46 is opened and the sub-stack 50 is moved in the transaction port 33 for the withdrawal.

Structurally, the box assembly 52 (FIGS. 1 and 2) has a frame of substantially parallelepiped shape of vertical extension with two sides 128 and 129, open on the front and on the back and includes three couples of endless conveyer belts 132, 133 and 134 actuated by the moving mechanism 60.

The belts 132, 133 and 134 extend horizontally and their upper and lower branches are longer than the maximum length of the acceptable banknotes. The upper and lower branches of each couple are substantially coplanar and, transversally, the branches are spaced away a distance such to receive, with safety, all the typologies of acceptable banknotes to be deposited.

The couples of belts 133 are interposed between the banknote box 53 and the discard box 54, whilst the couples 132 and 134 are respectively arranged at a higher surface in the box 53 and on a lower surface in the box 54. The lower branches of the belts 132 are arranged above the upper branches of the belts 133, whilst the upper branches of the belts 134 are below the lower branches of the belts 133.

The holding mechanisms 61 and 62 are provided for moving in height the couples of belts 132 and 134 with respect to the couple 133, varying the mutual distance therebetween. A configuration of minimum distance is designed for the taking of a stack or a sub-stack, to form a unitary set for the following shifting. A configuration of maximum distance provides, in the position "II" of the block 52, to receive the banknotes and the other components in optimal conditions for the formation of the sub-stacks 50 and 55.

The endless couple of belts 133 is in engagement with respective rollers supported in a median section of the box assembly 52. The endless couples of belts 132 and 134 are in engagement with other rollers, which are vertically supported in the rotation by shiftable platforms by the holding mechanisms 61 and 62. A motor 131 of the moving mechanism 60 actuates motor rollers of the rollers engaging the couples of belts 132, 133 and 134.

During the checking and validation step of the banknotes, position "II", the box 53 is adjacent to the final section of the path 72 to receive the recognized banknotes. The box 54 is adjacent to the final section of the path 73 to receive the constituting sheets not recognized, whilst the holding mechanisms 61 and 62 hold the belts 132 and 134 spaced away from the couple 133. In turn, the section 39 of the transport mechanism moves the validated banknotes in the box 53 and the constituting sheets not recognized in the box 54, forming the banknote sub-stack 50 on the belts 133 and the discard sub-stack 55 on the belts 134.

At the end of the separating operation, the processing unit 40 actuates the holding mechanism 62 of the box 54, lifting the belts 134 to arrest the sub-stack 55 against the belts 133. Then, the unity 40 actuates the vertical shifting mechanism, lifting the block 52 up to the position, not shown, in which the discard box 54 is adjacent to the transaction port 33 and the banknote box 53 is above thereto. In a return step, the processing unit 40 actuates the mechanisms 60 and 62 to move the discard sub-stack 55 toward the transaction port 33 and spacing away the belts 134 for the restitution.

The separating device 36 includes a motor 184, a couple of conveyer belts 186 actuated by the motor 184, a series of separating rollers 202 and refusal rollers 203, a separating motor 204 of actuation for the rollers 202 and a pressure member 206. The conveyer belts 186 support the stack 24 or the sub-stack 50, 55 in contrast with the pressure member 206 and, upon actuation, advance the stack or sub-stack, or the lower component sheet thereof.

The separating rollers 202 are continuously rotated in the sense of the separation, whilst the refusal rollers 203 are interposed with interference between the rollers 202 and are rotated in opposite sense for avoiding double feeding of the banknotes or sheets, in a manner known per se.

The sections 38 and 39 of the transport mechanism present two couples of transport endless belts 216 and, respectively, 217, and in which the belts are arranged side by side on guide rollers of the frame 47. The banknotes 23 are held by the transport belts or are followed in the movement by a couple of contrast belts 219 of the section 38 and by three couples of contrast belts 221, 222 and 223 of the section 39. The transport belts and the contrast belts are substantially put in synchronism and at a constant at velocity Vt, through toothed belts not shown in the drawings, by a transport motor 218. The banknotes are consequently transported at the same velocity Vt.

The endless belts 217 and the contrast belts 221 in the section 39 define the common path 69 and the path 72, whilst the belts 217 and the contrast belts 222 and 223 respectively define the path 71 and the path 73. For the deviations from the path 71 diverters 224 and 226 are provided, which are actuated by respective electromagnets 227 and 228, in turn servoized to the validation device 37. The diverter 224 moves the banknotes 23 of the path 69 along the path 72, whilst the diverter 226 moves the discards of the path 71 along the path 73.

The movement of the banknotes and the discards toward the boxes 53 and 54, along the final sections of the paths 72 and, respectively 73, is effected by two couples of opposite rollers 231 and 232, kept in rotation by the motor 218 with peripheral velocity synchronous with the velocity of the belts 217. The couples of rollers 231 and 232 are protected by a wall 233 and are adjacent to windows 234 and 236 at different height. In the configuration "II", the cells 52 and 53 are in front of the couples of rollers 231 and 232, and the windows 234, to form the sub-stacks 50 and 55 above the upper branches of the belts 133 and 134.

The piling of the banknotes and the other components generally occurs after a strike of the leading edges against the front 41 of the structure 42 and the components of smaller length are subject to dispose the trailing edges advanced with respect to the trailing edges of the other ones. When the sub-stacks are of high thickness, it represents a risk of interference for the following incoming banknotes. The risk is well greater when the incoming banknote is worn-out and the last piled banknote has its trailing edge folded upward. The irregularities of piling are also source of problems in the following steps of transport and separation of the sub-stacks.

THE EQUIPMENT OF THE INVENTION

Figure 3:
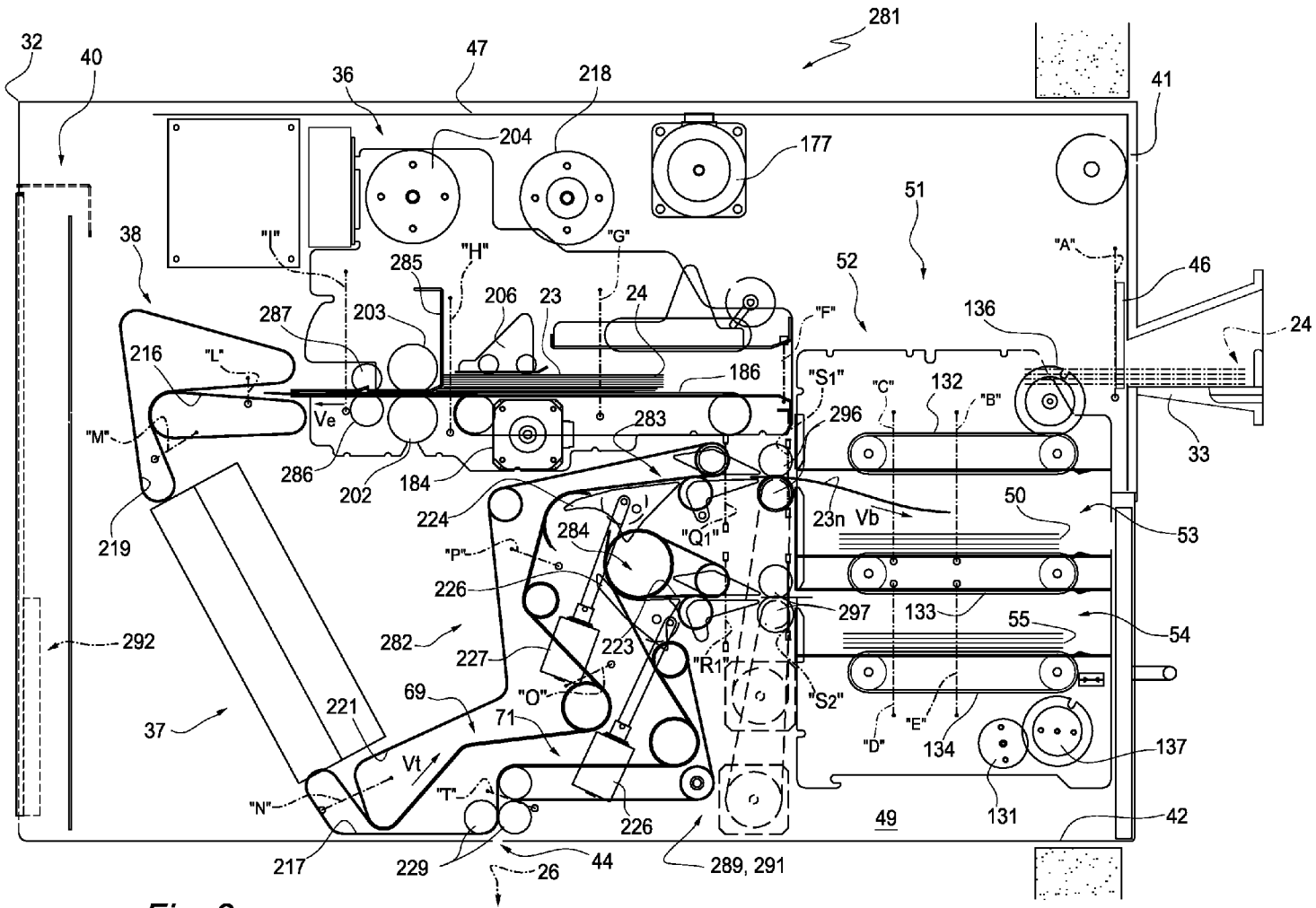
FIG. 3 represents a schematic lateral view of an equipment for processing banknotes in stack according to the invention.

An equipment for processing banknotes in stack according to the invention, is represented with 281 in FIG. 3. This equipment 281 solves the problems connected with the stacking of the banknotes and other sheets from the deposited stack, without substantial reduction of the operational speed.

In the following, the term banknotes will be used both for the true banknotes and for other component sheets of a stack and sub-stack.

The equipment 281 is similar to the equipment 22 of FIG. 1, but presents differences in the section 39 of the transport mechanism, herein represented with 282 and, specifically, in the path of deposit-capture 72 and the path of recognised banknotes 73, herein represented respectively with 283 and 284.

The separating device 36 includes, inter alia, a wall 285 with a lower slot between the transport belts 186 and the separating rollers 202, an extraction roller 286, and a pinch roller 287, and in which the rollers 286 and 287 are downstream of the separating rollers 202. The motor 204 is connected with the rollers 202 and 286 through a free-wheel mechanism and it is controlled by the processing unity 40 for a continuous rotation of the rollers with a peripheral extraction velocity Ve.

The photoelectric couple "H" is arranged upstream of the rollers 202 and the refusal rollers 203, adjacent to the wall 285, whilst the photoelectric couple "I" is downstream of the rollers 286 and 287. The processing unit 40 uses the signals from the photoelectric couple "H", preliminarily to the separating operation, for actuating the motor 184 in order to advance the stack or sub-stack of banknotes up to the wall 285.

The signals of the couple "I" are used for the control of the separating operation. In detail, the motor 184 make the lower banknote to advance through the lower slit; the stack or sub-stack is arrested by the wall 285, whilst the rollers 202 and 286 extract the lower banknote underneath the stack or sub-stack. The unit 40 arrests the motor 184 when the leading edge of the separated banknote crosses the photoelectric couple "I".

The banknote continues to be extracted by the rollers 202 and 286, going in engagement with the belts 216 and the contrast belts 219 of the transport mechanism. The peripheral velocity Ve of the rollers 202 and 286 is less of the transport velocity Vt but the free-wheel mechanisms allow the banknote and the rollers to accelerate whilst the banknote is still engaged with the same rollers 202 and 286.

On signalling of the photoelectric couple "I" the processing unit 40 actuates again the motor 204 to separate a new banknote, when the trailing edge of the extracted banknote has completely disengaged the rollers 286 and 287.

Figure 6:
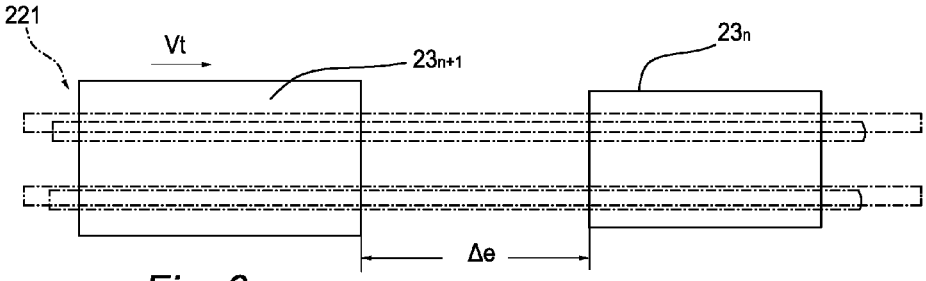
FIG. 6 is a schematic view of some operative characteristics of the equipments shown in the FIGS. 1 and 3.

The settings of the separating device 36 and the transport mechanism are such to define a safety distance Δe between the trailing edge of a banknote 23*n* and the leading edge of a following banknote 23*n*+1. It is schematized in FIG. 6, with reference to the condition in which the banknotes are engaged by the belts and the contrast belts for the transport. The distance Δe is also functional to ensure that the movement of actuation of the diverters occurs, without obstacles or jams, between a banknote and the following one and with a correct addressing, on the flight, toward the paths 283, 284 or 71.

Figure 7:
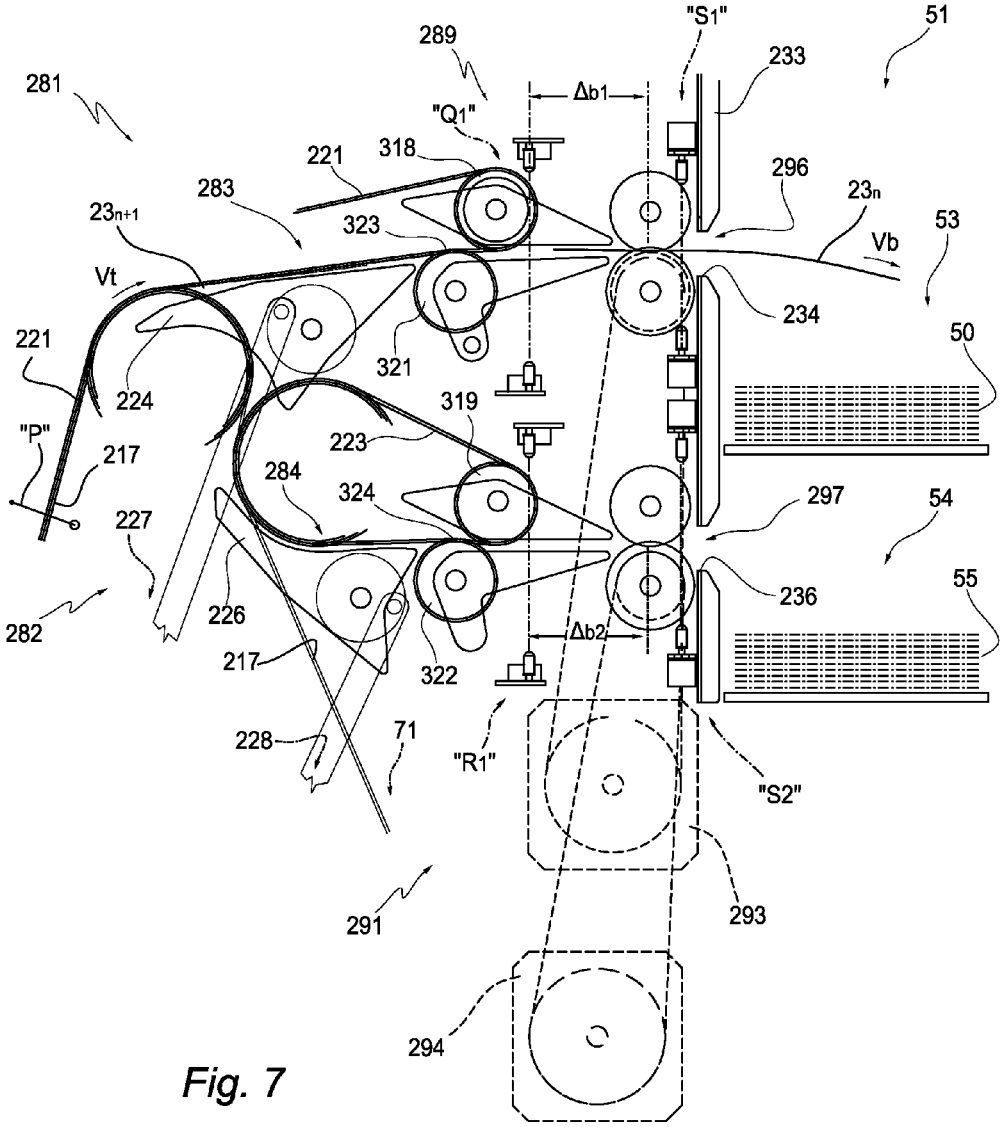
FIG. 7 represents, in enlarged scale, details of FIG. 3.

According to the invention, the equipment 281 (FIGS. 3 and 7) comprises interface mechanisms 289, 291 with nipping members to move the banknotes in output by the transport mechanisms and electronic circuits 292 of control for the mechanisms 289 and 291 for slowing down the banknotes outgoing from the transport mechanism at the input of the receiving sections.

The nipping members of the mechanisms 289, 291 are interposed between the output sections of the paths 283 and 284 and the inputs of the passage space 51; the electronic circuits 292 respond to information of transit of the banknotes for reducing the output velocity to a minimum value, optimal for the stacking.

The transport mechanism operates in continuous way, with velocity servo-control for a relatively high value of the transport velocity Vt. Advantageously, the slowing down of the banknotes in output by the interface mechanisms 289, 291 does not reduce the overall velocity of the equipment 281. As a matter of fact, the deceleration of the banknote is limited for being less than a spacing time Δt, of transit between the trailing edge of a banknote 23*n* and the leading edge of a following banknote 23*n*+1, at the output of the paths 283 and 284. This spacing time Δt corresponds to the ratio Δe/Vt between the safety distance Δe and (FIG. 6) and the transport velocity Vt.

In synthesis, the method to form the stacks or sub-stacks according to the invention provides the steps: a) setting the nipping members of the interface mechanism to receive a banknote from the transport mechanism at its transport velocity; b) actuating the nipping members to slow down the banknote disengaged from the transport mechanism up to a predetermined minimum velocity; c) disengaging the banknote from the nipping member for the superimposition on the stack or sub-stack in formation; and d) conditioning the nipping members to receive a following banknote to be stacked.

According to a first embodiment of the invention, the interface mechanisms 289, 291 (FIGS. 3, 7 and 10) comprise respective motors 293, 294 controlled by the circuits 292. The nipping members include couples of output rollers 296, 297, identical each the other, which are respectively connected in the rotation with the motors 293, 294, for instance through gears and toothed belts.

Figure 4:
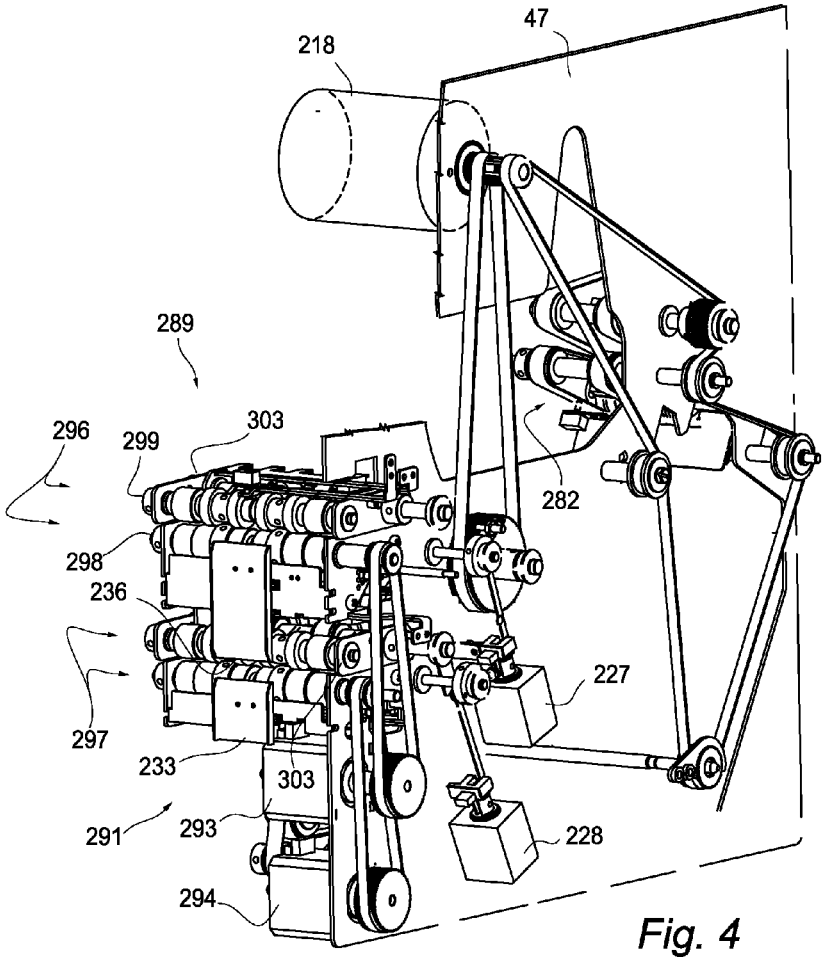
FIG. 4 shows, in a schematic perspective view, components of the equipment represented in FIG. 3.

The couples of output rollers of the mechanisms 289 and 291 also have function of a "draw member" for dynamically stiffen the banknotes in preparation of the stacking in the boxes 53 and 54. As an example, each couple of rollers 296, 297 (FIGS. 4 and 5) includes a motor shaft 298 and a shaft 299, parallel each the other, spaced away vertically and having couples of terminal rollers 301 and 302.

The motor shafts 298 are mounted on the frame 47 and are rotated by the motors 293, 294 through the pulleys and toothed belts; the shafts 299 are supported by respective oscillating frames 303 and are inclined toward the motor shafts 298 by strong load springs not shown in the drawings. It should be clear that, in alternative, also the shafts 299 could be connected in the rotation with the motors 293, 294.

Two drawing blocks 304 interposed between the terminal rollers 301 are keyed on the motor shaft 298. Each block 304 defines a central roller 306 with lateral hubs, which supports two other rollers 307 and 308. The rollers 307 and 308 are in elastomeric material and have a diameter larger of the one of the central roller 306.

Two contrast blocks 309 are keyed on the shaft 299, interposed between the terminal rollers 302. Each block 309 defines a central roller 311 of greatest diameter and two lateral rollers 312 and 313. The central rollers 311 are symmetrically arranged above the rollers 306, whilst the lateral rollers 312 and 313 are arranged above the rollers in elastomeric material 307 and 308.

Figure 5:
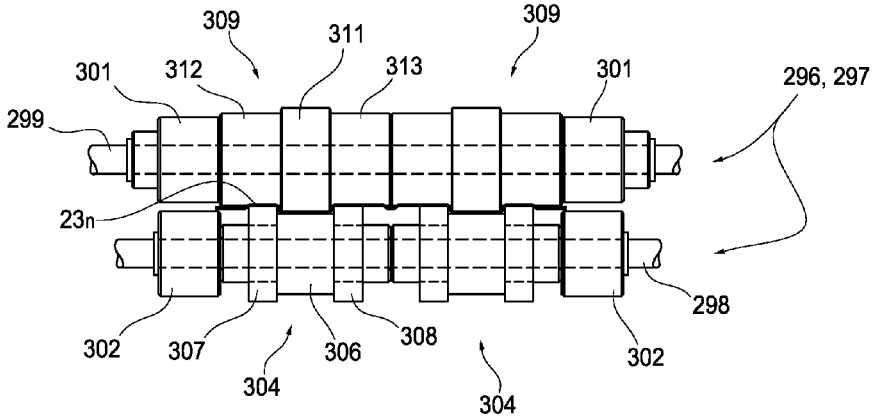
FIG. 5 is a front view, in enlarged scale, of details of FIG. 4.

At the moment of the passage, the structure above described causes a transversal deformation of the banknotes 23*n*, substantially as a Greek profile evidenced in FIG. 5. The longitudinal rigidity of the banknotes is substantially increased, with reduction of the deformations in the following steps of formation of the sub-stacks, also in the case of worn-out banknotes.

The paths 283 and 284 of the section of transport 282 (FIG. 7) are defined in the terminal portion by motor rollers 318, 319 and pinch rollers 321, 322. The motor rollers 318, 319 are in engagement with the portions of the transport belts 221 and 223 adjacent to the outputs toward the boxes 52 and 53, whilst the pinch rollers 321, 322 are in engagement with preceding portions of the belts 221 and 223. With this structure, the rollers 321 and 322 define nipping areas 323 and 324 with the belts 221 and 323, downstream of the diverters 224 and 226 and upstream of the couples of output rollers 296 and 297. These nipping areas represent the last area of engagement of the transport mechanism 282 with the banknote to be stacked. Guide elements, not numbered in the drawings, support and guide the banknotes between the areas of contact 323 and 324 and the couples of output rollers 296 and 297.

The motors 293 and 294 are, for instance, of stepping type and the electronic circuits 292 drive the motors in response to information regarding the disengagement of the banknotes from the nipping areas 321 and 322 along the paths 283 and 284. To this end, two photoelectric couples "Q1" and "R1" are provided which sense the banknotes in transit. The couples "Q1" and "R1" are arranged downstream of the nipping areas 323 and 324, adjacent to the motor rollers 318 and 319 and at a distance Δb1 Δb2 from the areas of engagement of the output rollers 296, 297.

Two photoelectric couples "S1" and "S2" are arranged closely downstream of the couples of rollers 296 and 297, adjacent to the windows 234 and 236, and recognize the passage of the banknotes through the inputs of the passage space 51.

Figure 10:
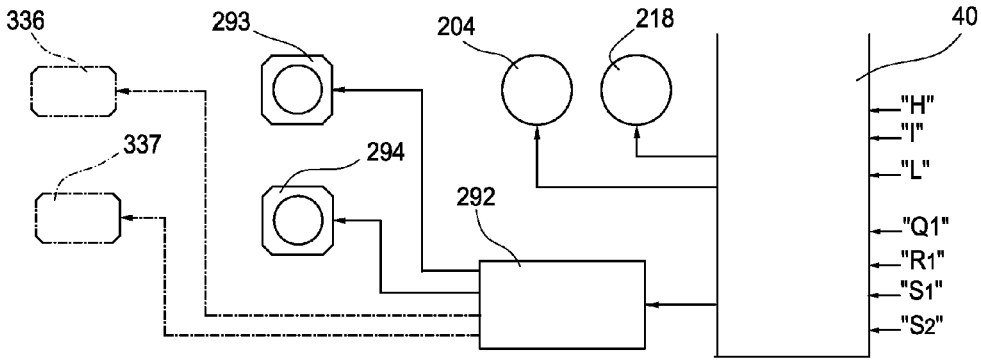
FIG. 10 represents a block electric diagram, of the equipment shown in FIG. 8.
Figure 11:
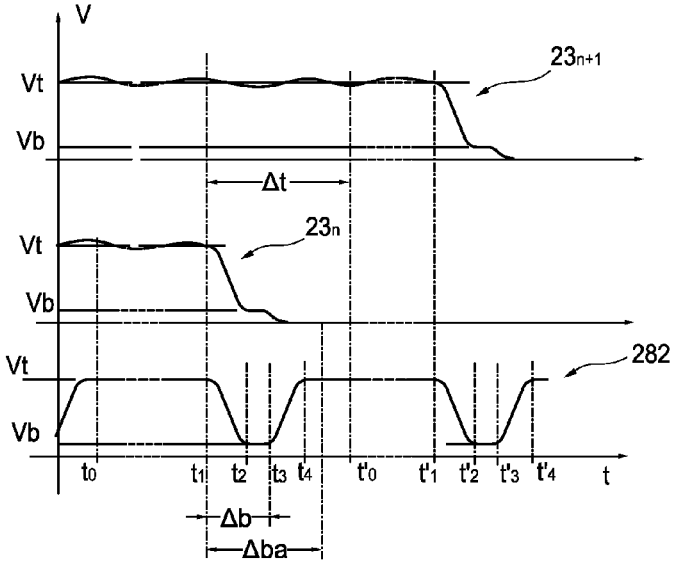
FIG. 11 is an operational diagram of the equipment according to the invention.

In the use, the circuits 292 drive the motors 293 and 294 to maintain the output rollers 296 and 297 at a peripheral velocity synchronous with the transport velocity Vt (see also FIGS. 10 and 11). Thus, a banknotes 23*n* leaving the area of contact 323, 324 is engaged by the rollers 296 or 297 to be transported at the velocity Vt and at a time "t0", and progressively projecting in the passage space 51.

The banknote 23*n* moves at the velocity Vt, up to a time "t1" in which the couple photoelectric "Q1", "R1" signals the passage of its trailing edge. Then, the circuits 288 quickly slow down the motor 293, 294, braking the banknote up to a minimum velocity Vb at a time "t2". The banknote further projects in the passage space 51 and disengages from the rollers 296, 297.

The banknote 23*n* crosses, by inertia, the window 234, 236 at the minimum velocity Vb, falling in the lower sub-stack 50, 55 with the trailing edge adjacent to the wall 233. In the meantime, the circuits 292 maintain actuated the motor 293 or 294 for the condition of transport at the velocity Vb. After the disengagement of the banknote, at a pre-defined time "t3" and a braking period Δb=t3−t1, the control circuits accelerate the motor 293, 294, so to reach, at a time "t4", the condition of transport of the rollers 296 or 297 at the transport velocity Vt. It occurs in a braking-acceleration period Δba=t4−t1 less than the spacing time Δt associated to the safety distance Δe.

The following banknote 23*n*+1 will be engaged by the output rollers 296 or 297 at the velocity Vt, without problems, at a time "t'0">"t4", it will begin to slow down at the time "t'1", and will reach the minimum velocity Vb at the time "t'2". The circuits 288 will control in turn the motor 293, 294 in the above-described manner.

In this embodiment of the invention, the interface mechanisms 289 and 291 execute the steps: a) engagement of the nipping members with the banknote in transit in synchronism with the section 282 of the transport mechanism, up to the disengagement from the transport mechanism; b) deceleration of the nipping members up to the predetermined minimum velocity of the banknote; c) disengagement of the banknote from the nipping members of the stacking mechanism for the stacking thereof on the stack in formation; and d) acceleration of the nipping members for the engagement, in the condition of synchronism with the following banknote to be stacked.

Figure 12:
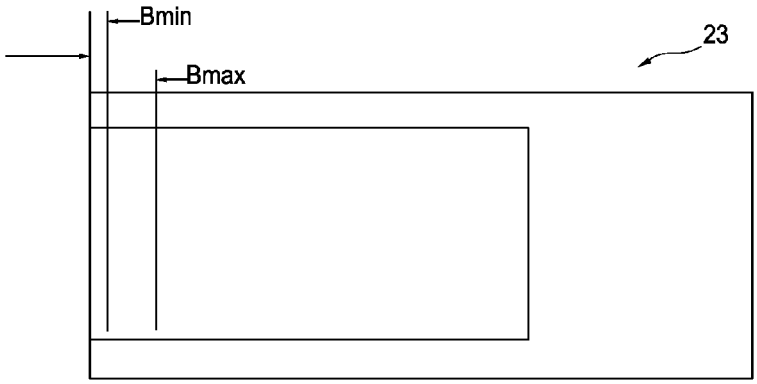
FIG. 12 is a schematic view, showing functional characteristics of the equipment shown in the FIGS. 3, 8 and 9.

The area of banknote 23*n* interested to the taking for the deceleration depends in length on the distance Δb1, Δb2 between the photoelectric couples and the rollers 292, 293. This area can vary between a value Bmin and a value Bmax, (FIG. 12) in dependence on various factors, as fluctuations of the transport velocity Vt and inclination of the banknotes with respect to the photoelectric couples.

The circuits 292 (FIG. 10) can be programmed so to determine a gradual deceleration of the motors 293, 294, for slowing down, without vibrations, the banknotes in output.

The dimensional differences or of state of the banknotes and the differences of response of the interface mechanisms do not modify the conditions of stacking. In fact, the variations of the nipping areas cause only a variation of the interval of time during which the banknote maintains the minimum velocity before the disengagement from the output rollers, without any consequence in the formation of the stacks.

The minimal braking velocity Vb (FIGS. 7 and 11) can be particularly low, sufficient to the disengagement of the tails of the banknotes from the output rollers 296, 297 and from the windows 234 and 236. This velocity can be included between a value next to zero and a value equal to the 50% of the transport velocity Vt. As an example, the velocity Vb is included in the field between 0.2 Vt and 0.4 Vt.

Figure 8:
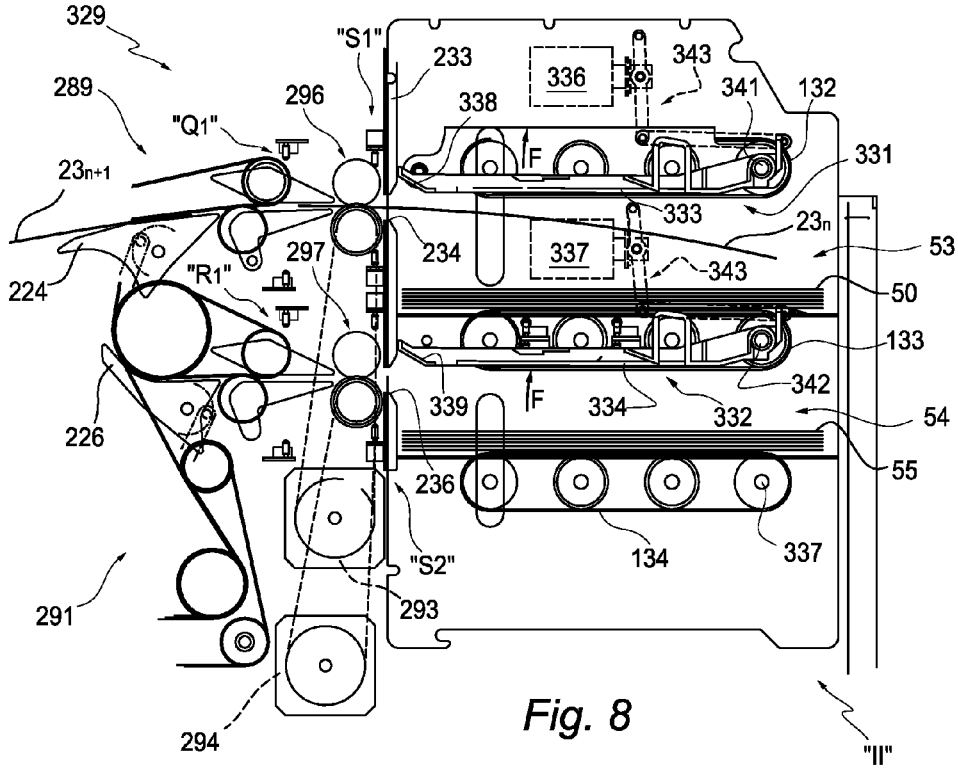
FIG. 8 shows a partial schematic lateral view of another embodiment of the equipment of FIG. 3, in a given operational configuration.
Figure 9:
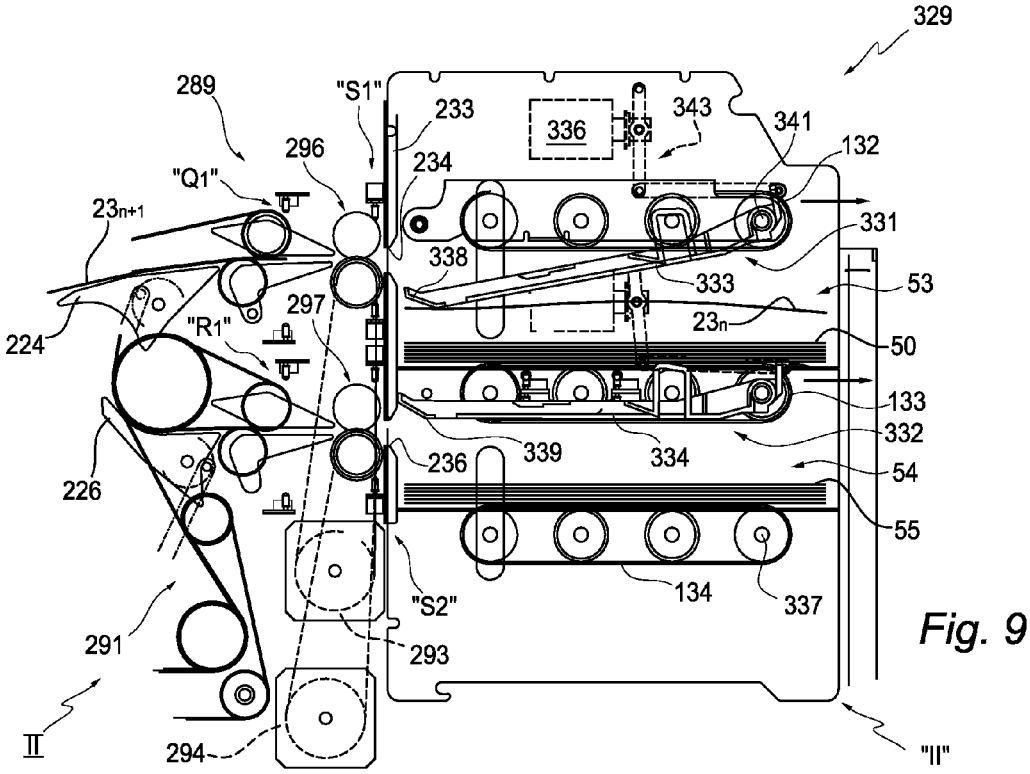
FIG. 9 shows the embodiment of FIG. 8, in another operational configuration.

Another embodiment of the equipment for processing banknotes in stack according to the invention is represented with 329 in the FIGS. 8 and 9. The equipment 329 includes two extraction mechanisms 331 and 332, associated with the interface mechanisms 289 and 291 and actuatable to facilitate the separation and the removal of the trailing edges of the banknotes to be stacked from the windows 234 and 236.

The extraction mechanisms 331 and 332 comprise two respective shovel levers 333 and 334 and electromagnets 336 and 337 controlled by the circuit 292 (see FIG. 10). The shovel levers 333 and 334 have a substantially "T" shape and longitudinally extend for a good portion of the boxes 53 and 54. Each shovel lever has a central portion interposed between the belts 132 and 133, a conventionally front portion 338, 339, direct toward the wall 233 and a rear portion of fulcrum on the box assembly 52.

The front portions 338, 339 of the shovel levers 333 and 334, corresponding to the arms of the "T", extend though the distance between the belts 132 and 133 and are tapered, whilst the back portions are fulcrumed on shafts 341, 342, of support for the back motor rollers of the belts 132, 133.

The shovel levers 333 and 334 are connected with the electromagnets 336, 337 through advantages 343 and are opposed by return springs generically represented by an arrow "F". In condition of rest and in the configuration "II" of FIG. 8, the return springs maintain the shovel levers 333, 334 in horizontal position few underneath the belts 132 and 133, and above the windows 234 and 236. With this arrangement, the impulsive actuation of an electromagnet 336, 337 causes a quick counter-clockwise rotation in sense of the shovel lever 333 334 with lowering of the portion 338, 339, underneath the window 234, 236 and, for instance, above the sub-stack 50, 55 in formation.

In the use, the circuits 292 (FIG. 10) actuate the electromagnet 336, 337, in response to signals from the photoelectric couple "S1", "S2" (FIGS. 8 and 9) associated with the passage of the trailing edge of the banknote 23*n* disengaged from the output rollers 296, 297. The tail of the banknote is quickly removed from the window 234, 236, as shown in FIG. 9, and lowered along the wall 233, whilst the banknote overlaps in orderly way on the sub-stack 50, 55, for the stacking.

The equipments according to the invention ensure the processing of 8-10 banknotes/sec. The velocity of extraction is included between 0.5 and 2.5 m/sec and the safety distance Δe between the edges of the banknotes is between 20 and 80 mm. The velocity Vt of the transport mechanism has a substantially constant and relatively high value of 1÷2 m/sec.

Figure 13:
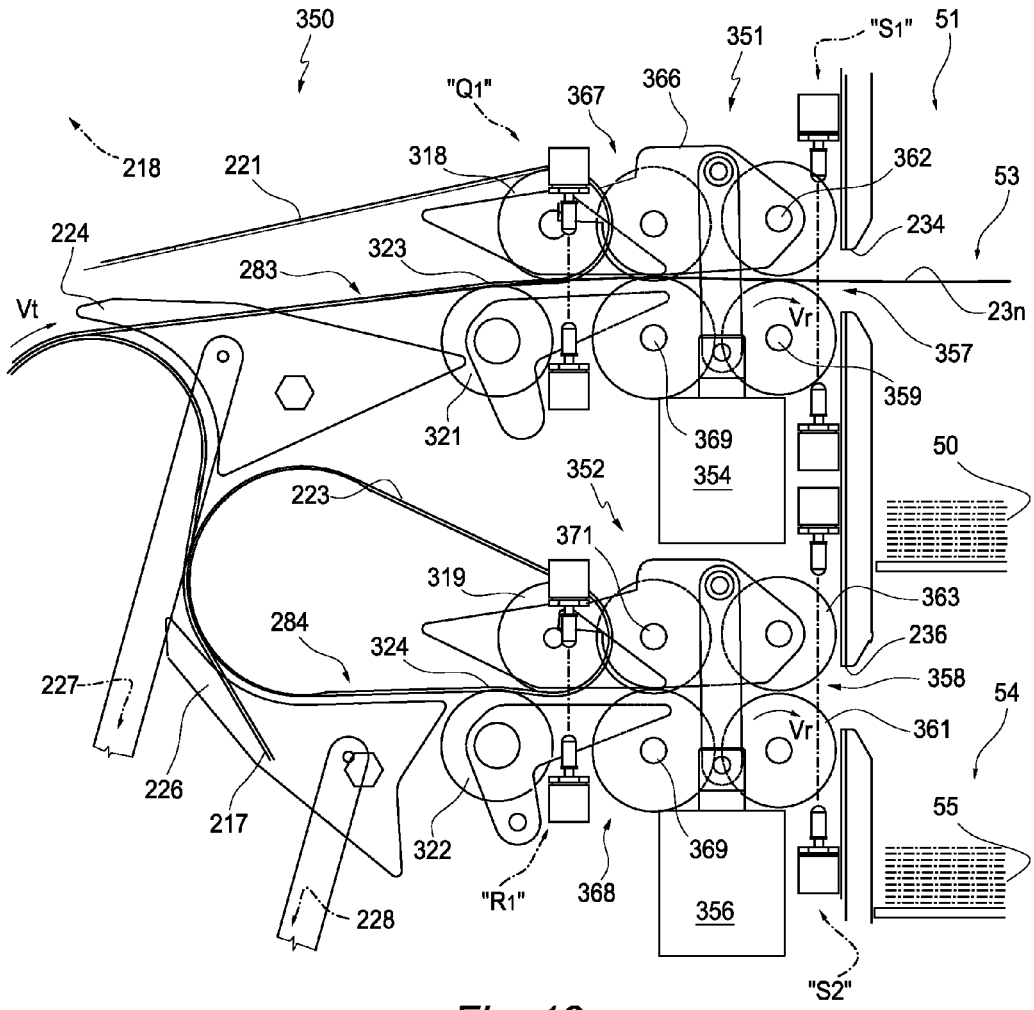
FIG. 13 represents, in a schematic lateral view, a further embodiment of the equipment according to the invention.
Figure 14:
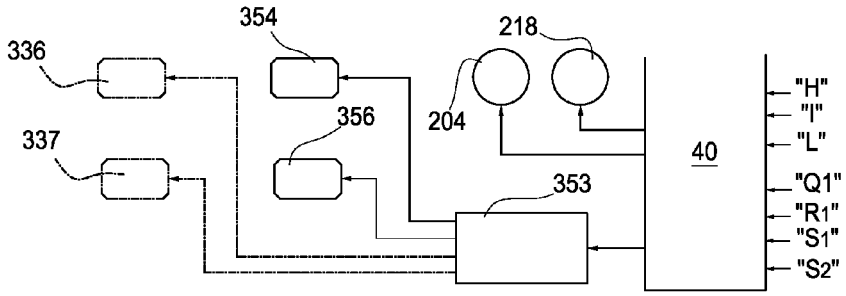
FIG. 14 shows a block electric diagram, of the equipment represented in FIG. 13.
Figure 15:
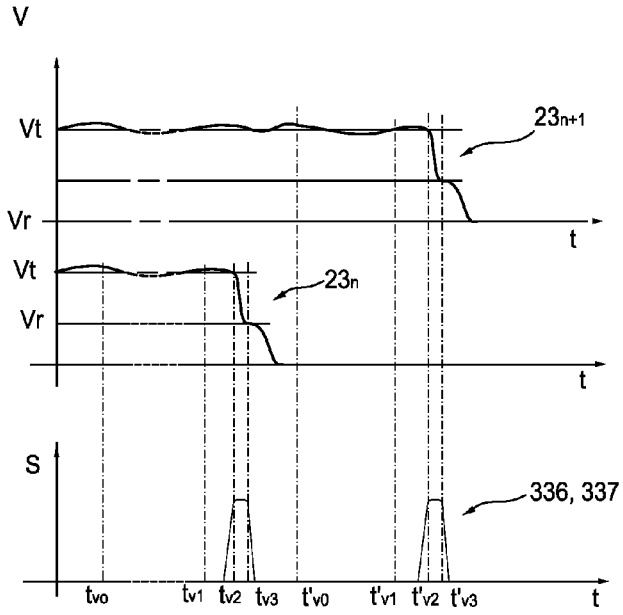
FIG. 15 is an operational diagram of the embodiment represented in FIG. 13.

A further embodiment of the equipment for processing banknotes in stack of the invention, represented with 350 is partially shown in the FIGS. 13 and 15. The equipment 350 includes components identical to the ones of the equipment 281 or 329, interface mechanisms 351 and 352 and electronic control circuits 353, different but similarly predisposed for slowing down the banknotes or sheets outgoing from the transport mechanism at the input of the receiving sections.

The interface mechanisms 351, 352 include respective electromagnets 354, 356 and, as nipping members, couples of output rollers 357, 358, identical each the other and interposed between the output sections of the paths 283 and 284 and the windows 234 and 236. In this embodiment, the output rollers are connected in the rotation with the transport motor 218 and are actuatable for the condition of deceleration of the banknotes by the electromagnets 354, 356.

Figure 16:
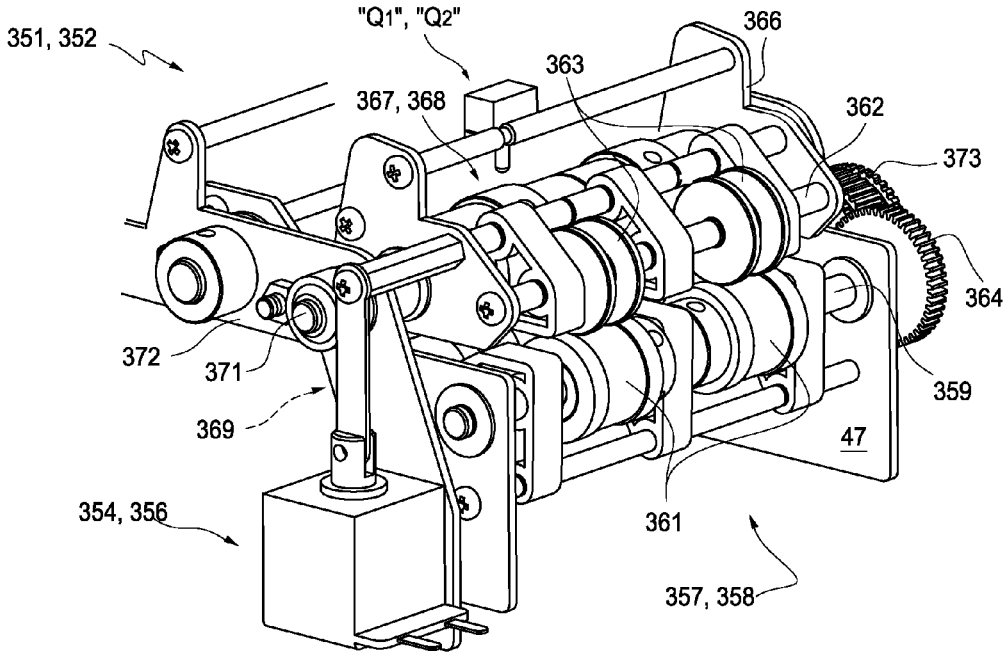
FIG. 16 shows a perspective view of some components of FIG. 13.

Each couple of output rollers 357, 358 (FIG. 16) has a motor shaft 359 with dragging rollers 361 and a shaft 362 with pinch rollers 363, parallel each the other and vertically spaced away. The motor shaft 359 is rotatable on the frame 47 and on this shaft is keyed a gear 364 in engagement with the toothed belts of the transport mechanism, not shown in the drawings.

Suitably, the above-mentioned mechanism is designed so that the peripheral velocity of the dragging rollers 361, represented with Vr, is a fraction of the velocity of transport of the transport mechanism. For instance, the peripheral velocity Vr is included between 0.2 Vt and 0.6 Vt.

The shaft 362 (FIGS. 13 and 16) is idle rotatable on a swinging frame 366 connected with the mobile component of the electromagnet 354, 356. The frame 366 is shiftable between a condition of disengagement in which the pinch rollers 363 are spaced from the dragging rollers 361 and a condition of engagement in which the pinch rollers 363 are in taking with the dragging rollers 361.

At electromagnet 354, 356 de-actuated, the frame 366 is in the condition of disengagement. Thus, the transport of a banknote outgoing from the path 283, 284 at the velocity Vt and still in taking with the transport belts will be not disturbed by the rollers 361 rotating at the reduced peripheral velocity Vr.

In the equipment 350 of the further embodiment, the interface mechanisms 351 and 352 execute the steps: a) transit of the banknotes outgoing from the section 282, 284 through the spaced nipping members at the velocity of synchronism and disengagement of the banknotes from the transport mechanism; b) actuation of the nipping members with deceleration of the banknotes up to the predetermined minimum velocity; c) disengagement of the banknotes from the nipping members for the piling on the stacks in formation; and d) de-actuation of the nipping members for the transit of the following banknote at the velocity of synchronism.

Also the equipment 350 can comprise mechanisms for the dynamic stiffening of the banknotes associated with the interface mechanisms 351 and 352. As an example couples of draw members 367, 368 could be provided, substantially identical to the couples of output rollers 296, 297 of the equipment 281. These members include a motor shaft 369 and a shaft 371, parallel each the other and vertically spaced away. The motor shafts 369 are rotatable on the frame 47 and carry drawing blocks; whilst the shafts 371 carry corresponding contrast blocks and are supported by oscillating frames 372 inclined toward the shafts 369 by strong load springs not shown in the drawings.

On each motor shaft 369 are keyed a pulley 373 in engagement with one of the toothed belts of the transport mechanism, sized to define a peripheral velocity of the drawing blocks equal to the velocity of transport Vt of the transport mechanism.

The dragging rollers 361 and the rollers of contrast 362 are arranged with respect to the drawing blocks of the couples 368 and 369 to maintain the conditions of transversal deformation of the drawn banknotes.

On operational conditions, a banknote 23*n* emerging from the area of contact 323, 324 (FIG. 13) is engaged by the couple of draw members 367, 368 and is transversally deformed at the velocity Vt, whilst the circuits 351 maintain the electromagnets 354, 356 de-actuated. Thus, at a time "tv0", (see FIG. 15) the banknote bears slight frictioned and without stumbles, on the dragging rollers 361, progressively projecting in the passage space 51.

The banknote 23*n* continue the movement at the velocity Vt up to a time "tv1" in which the photoelectric couple "Q1", "R1" signals the passage of the trailing edge. At a time "tv2", the circuits 351 activate the electromagnet 354, 356, carrying the pinch rollers 363 to press on the banknote against the dragging rollers 362. The delay is adjusted to allow the edge of the banknote to cross the distance between the line of the photoelectric couple "Q1", "R1" and the area of engagement of the couple of draw members 367, 368. The banknote will be therefore quickly braked up to the velocity Vr and, subsequently projecting in the passage space, it will disengage the rollers 361 and 362.

The banknote 23*n* now crosses by inertia the window 234, 236 at the minimum velocity Vr, falling in the lower sub-stack with the trailing edge adjacent to the wall 233. In the meantime, the circuits 351 de-actuate the electromagnet 354, 356 at the time "tv3", to space the pinch rollers 363 away from the dragging rollers 361. The following banknote 23*n*+1 will be taken between the output rollers at the velocity Vt at a time "t0">"tv3" and will be braked at the velocity Vr at the time "tv2" up to the disengagement at the time "tv3", in the already described way.

The extraction mechanisms 331 and 332, if present, will operate in the way previously described on control of the circuits 353.

In alternative to the condition of engagement-disengagement of a nipping member with the banknotes to be stacked, a nipping member can be provided, having motor rollers and pinch rollers always engageable with the banknote in transit and in which the motor rollers are connected with the transport motor through a clutch or gear, for instance of electromagnetic control. The clutch or gear normally holds the motor rollers in the condition of synchronism with the transport belts and it is actuatable on control of the circuits 351 to modify the transmission ratio for the value of reduced peripheral velocity Vr of the motor rollers.

The information of transit of the banknotes can be supplied by photoelectric elements arranged in different portions of the paths 283, 284. For instance, a photoelectric couple "P" (FIG. 3), upstream of the diverter 224 could be provided to supply the transit information. Other sensing means could be provided, responsive to information connected with the passage of the edges of input and/or to other information supplied by the processing unit 40 on the basis of data from the validation device 37.

The structures and the method of the invention find application also in equipments, which have a single receiving section for the formation of stacks of banknotes or sheets not recognized, and/or different receiving sections for the other sheets. More than two receiving sections could be provided.

The invention is also applicable in equipments with two or more receiving sections, but in which the use of the interface mechanism and/or the extraction mechanism is limited to a sole receiving section.

Naturally, the principle of the invention remaining the same, the embodiments and the details of construction of the equipment for processing banknotes can be broadly varied with respect to what has been described and illustrated by way of non-limitative example, without by this departing from the ambit of the present invention.

What is claimed is:

1. Equipment for processing banknotes in stack including a transport mechanism for individually transporting banknotes or similar sheets, and a receiving section for receiving, in superimposition, transported banknotes or sheets, wherein the banknotes or sheets are transported at a given transport velocity (Vt) and the receiving section is arranged downstream of an output section of the transport mechanism, said equipment including transport sensing elements, and further comprising:

an interface mechanism with nipping members interposed between said section of the transport mechanism and the receiving section; and at least one electronic control circuit operative on the interface mechanism for causing the nipping members to slow down the banknotes or sheets at the input of the receiving section making easy a regular stacking of the banknotes or sheets;

the nipping members being engageable with the banknotes or sheets outgoing from the said section of the transport mechanism for the transport of the banknotes or sheets at a velocity (Vb, Vr) reduced with respect to the given transport velocity (Vt); and the at least one electronic circuit controlling the interface mechanism in response to the information of transit of the banknotes or sheets;

wherein an extraction mechanism is actuatable in a stacking step to push a pre-defined portion of the slowed down banknotes toward banknotes or sheets stacked in said receiving section and in which the electronic circuits control the extraction mechanism to engage, as pre-defined portion, a terminal area of the banknotes adjacent to respective trailing edge thereof;

a sensing element arranged downstream of the nipping member and adjacent thereto and wherein said at least one electronic circuit responds to signals of the sensing element associated with the transit of the trailing of the banknote or sheet to synchronize the extraction mechanism with the transit of said trailing edges; and a wall defining an output window for the banknotes or sheets to be stacked, wherein said window is adjacent to the said nipping members and wherein said extraction mechanism comprises a shovel lever actuatable for cooperating with the pre-defined portion of the banknote or sheet in stacking, said shovel lever having a terminal section adjacent to said window to cooperate with the terminal area of the banknote in stacking.

* * * * *